US006976430B2

(12) United States Patent
Kinoshita et al.

(10) Patent No.: US 6,976,430 B2
(45) Date of Patent: Dec. 20, 2005

(54) IGNITER FOR INFLATOR AND METHOD OF MANUFACTURING THEREOF

(75) Inventors: Gen Kinoshita, Himeji (JP); Hiroshi Harada, Himeji (JP); Shingo Oda, Himeji (JP)

(73) Assignee: Daicel Chemical Industries, Ltd., Osaka (JP)

( * ) Notice: Subject to any disclaimer, the term of this patent is extended or adjusted under 35 U.S.C. 154(b) by 25 days.

(21) Appl. No.: 10/652,238

(22) Filed: Sep. 2, 2003

(65) Prior Publication Data

US 2004/0144458 A1 Jul. 29, 2004

Related U.S. Application Data

(60) Provisional application No. 60/408,325, filed on Sep. 6, 2002.

(30) Foreign Application Priority Data

Sep. 2, 2002 (JP) ..... 2002-256565
Aug. 27, 2003 (JP) ..... 2003-302679

(51) Int. Cl.[7] ..... F42B 3/10; C06B 36/00
(52) U.S. Cl. ..... 102/202.5; 149/37
(58) Field of Search ..... 149/37, 77; 102/202.5, 102/202.9, 202.14, 202.12, 202.1

(56) References Cited

U.S. PATENT DOCUMENTS

| | | | |
|---|---|---|---|
| 5,686,691 | A | 11/1997 | Hamilton et al. |
| 6,009,809 | A | 1/2000 | Whang |
| 6,354,217 | B1 | 3/2002 | Narumi et al. |
| 6,578,487 | B2 | 6/2003 | Avetisian et al. |
| 6,779,456 | B2 | 8/2004 | Avetisian |
| 6,848,365 | B2 | 2/2005 | Avetisian et al. |
| 2004/0000248 | A1 | 1/2004 | Avetisian et al. |
| 2004/0174791 | A1 | 9/2004 | Avetisian et al. |

FOREIGN PATENT DOCUMENTS

| | | | |
|---|---|---|---|
| JP | 57-52543 | U | 3/1982 |
| JP | 9-210593 | A | 8/1997 |
| JP | 10-325699 | A | 12/1998 |
| JP | 3064725 | U | 9/1999 |
| JP | 2000-292100 | A | 10/2000 |
| JP | 2001-116495 | A | 4/2001 |

*Primary Examiner*—Aileen Felton
(74) *Attorney, Agent, or Firm*—Birch, Stewart, Kolasch & Birch, LLP

(57) ABSTRACT

An igniter for an inflator has a heat generating body provided on a bottom surface of a pyrotechnic material accomodating space. By dripping a pyrotechnic material slurry including a fuel component and an oxidizing agent component dispersed in a solvent from above the accomodating space upon manufacturing the igniter, the heat generating body can be prevented from being damaged.

26 Claims, 3 Drawing Sheets

IGNITER FOR INFLATOR AND METHOD OF MANUFACTURING THEREOF

This Nonprovisional application claims priority under 35 U.S.C. §119(e) on U.S. Provisional Application No. 60/408,352 filed on Sep. 6, 2002 and under 35 U.S.C. §119(a) on Patent Application Nos. 2002-256565 and 2003-302679 filed in Japan on Sep. 2, 2002 and Aug. 27, 2003, the entire contents of which are hereby incorporated by reference.

BACKGROUND OF THE INVENTION

1. Field of the Invention

The present invention relates to an igniter suitably used in an inflator for an air bag and a method of manufacturing the same.

2. Description of the Related Art

Conventionally, in an inflator for an airbag, an igniter is used as a detonator. In recent years, the so-called electric type igniter is predominate, which is an igniter receiving an electric activating signal and converting the same into a thermal energy to ignite and burn a pyrotechnic material.

The electrical igniter generally includes a pair of electroconductive pins receiving an electric activating signal, an electric resistance wire electrically connected between electroconductive pins, and a pyrotechnic material (namely, a priming) provided to come in contact with the electric resistance wire. When the electroconductive pins receive an activation signal and an electric current flows in the electric resistance wire, the resistance wire is heated and ignites the pyrotechnic material.

Since the electric type igniter functions to start activation of an inflator for an air bag, it is important that the electric igniter is activated unfailingly, as necessary. Regarding the activation reliability, JP 09-210596 A discloses, as important factors for a performance of an electrical detonator, a structural completeness of a bridge wire for maintaining a proper connection between a bridge wire and a pyrotechnic material (for example, contact between both being excellent for ignition) and for maintaining an electric circuit in a closed state (for example, for reducing a risk of disconnection of the bridge wire).

Another conventional technique relating to the present invention is disclosed in U.S. Pat. No. 6,009,809 B.

SUMMARY OF THE INVENTION

The present invention relates to an igniter used suitably in an inflator for an air bag and a method of manufacturing the same, and in particular, to an igniter for an inflator characterized in a charging method of a pyrotechnic material (or a priming) which burns upon activation to generate a flame and the like, and to a method of manufacturing the same.

In the method described in JP 09-210596A, a first slurry (a pyrotechnic material slurry) charged from an opened end of a charge casing has a high viscosity of 500,000 centipoises or more. Therefore, even in case of charging the slurry into the charge casing, a projection is formed on its upper surface (that is, in the side where an ignition assembly is charged) at the time of charging, so that it becomes difficult to maintain the upper surface horizontal. Therefore, in order to make the upper surface horizontal, it is necessary to employ any means therefore at the time of charging the slurry. If no means is employed and the upper surface is not made horizontal, that is, if it dries with projections, the bridge wire is possibly cut by the projections at the time of mounting an ignition assembly to the opened end of the charge casing.

Further, even if the upper surface of the first slurry was horizontal, the ignition assembly provided with the bridge wire is mounted to the first slurry (pyrotechnic material slurry) which is mounted to the charge casing to be dried and solidified, so that the bridge wire is pressed against the solidified material, which may damage the bridge wire.

In view of the above, an object of the present invention is to provide an igniter for an inflator which solves the above-described problems in the conventional art, does not damage a heat generating body that generates heat with an ignition current applied to a bridge wire or the like, and makes the heat generating body and a pyrotechnic material securely in contact with each other. Further, the present invention may facilitate the manufacturing steps, and provides a method of manufacturing such an igniter.

The present invention provides, as means for solving the above problem, an igniter for an inflator provided with a pyrotechnic material accommodating space for accommodating a pyrotechnic material, and a heat generating body, for generating heat when an ignition current is applied, provided on a bottom surface of the pyrotechnic material accommodating space, wherein the pyrotechnic material is one obtained by charging a pyrotechnic material slurry, which includes a fuel component and an oxidizing agent component dispersed in a solvent, into the pyrotechnic material accommodating space and drying the same, and the pyrotechnic material in the pyrotechnic material accommodating space surrounds the heat generating body and closely makes contact with the same.

The pyrotechnic material is one obtained by charging, into the pyrotechnic material accommodating space, a pyrotechnic material slurry, which includes a fuel component and an oxidizing agent component dispersed in a solvent, and drying the same. Accordingly, the charged pyrotechnic material slurry is dried and solidified while surrounding the heat generating body, so that it is unnecessary to press the heat generating body against the solidified pyrotechnic material, thereby preventing the heat generating body from being damaged or cut, and making the heat generating body and the pyrotechnic material make contact more securely. In particular, when the viscosity of the pyrotechnic material slurry to be charged is low, the whole heat generating body in the pyrotechnic material accommodating space is surrounded by the pyrotechnic material, which is different from a case where a heat generating body is pressed against a solidified pyrotechnic material, so that contact of the pyrotechnic material with the heat generating body is improved. As a result, an activation reliability can be improved.

The pyrotechnic material slurry is, before being dried, one obtained by evenly dispersing a fuel component in a solvent to form a fuel slurry and further dispersing an oxidizing agent component evenly in the fuel slurry. In particular, in case of a fuel component comprising only a metal component, it is difficult to handle because the fuel component has a high ignition sensitivity in a powdery state. But, by dispersing the fuel component in the solvent together with a binder, the fuel component is not handled in the powdery state. In this case, in the fuel slurry, a metal component has to be maintained evenly dispersed in the solvent, and thereby, the fuel slurry needs to be stirred sufficiently. At this time, if the viscosity of the fuel slurry is in the range of 1,000 to 500,000 centipoises, the slurry can be stirred sufficiently and the fuel slurry in which the fuel component is evenly dispersed in the solvent can be formed.

Further, since the pyrotechnic material is formed by charging the pyrotechnic material slurry into the pyrotechnic material accommodating space and drying the same, it is necessary to evenly disperse the fuel component and the oxidizing agent component in the pyrotechnic material slurry in order to make ignition of the pyrotechnic material secure. Therefore, when the viscosity of the pyrotechnic material slurry is put in the range of 1,000 to 500,000 centipoises, stirring can be conducted sufficiently to form a pyrotechnic material slurry in which the fuel component and the oxidizing agent component are evenly dispersed in the solvent. By charging the sufficiently stirred pyrotechnic material slurry in the pyrotechnic material accommodating space of the igniter and drying the same, the igniter produced finally includes the pyrotechnic material having the fuel component and the oxidizing agent component evenly dispersed. In such an igniter, since the pyrotechnic material in which the fuel component and the oxidizing agent component are evenly dispersed makes close contact with the heat generating body, the pyrotechnic material is securely ignited by the heat generated by the heat generating body, so that a reliability of an ignition performance can be maintained.

Further, since the pyrotechnic material is charged in the pyrotechnic material accommodating space in a slurry state, a charge holder defining a periphery of the pyrotechnic material accommodating space can be formed with an inflammable material such as synthetic resin. At the time of charging the pyrotechnic material, if the pyrotechnic material is a dried-powdered material, it is necessary to secure contact between the heat generating body and the pyrotechnic material after charged into the pyrotechnic material accommodating space by applying a force on the charged pyrotechnic material, such as by pressing the pyrotechnic material against the heat generating body with a convex portion formed at a closed end of a cup as disclosed in, for example, U.S. Pat. No. 6,000,809 B. At this time, a force is applied to the charge holder, so that the charge holder maybe deformed. In the present invention, however, the pyrotechnic material is in a slurry state, and it can be simply charged without applying a pressure on the material. Accordingly, a charge holder made of resin can be used and the thickness of the charge holder can also be made thin. Therefore, according to the igniter for an inflator of the present invention, a charge holder made of an inflammable material such as a resin or the like can be used and undesirable deformation of the charge holder can be prevented. Further, the charge holder is mounted to a portion (a header portion) where the heat generating body is provided to form the pyrotechnic material accommodating space. When the charge holder is made of an inflammable material, the charge holder can be fixed by a simple method such as adhesion to the header portion using adhesive, and the charge holder is burnt out due to combustion of the pyrotechnic material so that the charge holder is prevented from scattering at the time of activation of the igniter even if the adhesion to the header portion is weak. Further, even if the charge holder is formed of metal, the thickness thereof can be made thin, and thereby the charge holder can be formed easily by pressing. As a result, a manufacturing cost can be reduced.

The heat generating body can be not only formed as a bridge wire comprising an electric resistance wire but also formed as the heat generating portion on a substrate at least part of which is disposed in the pyrotechnic material accommodating space. When the heat generating body is formed as the heat generating portion on the substrate, the heat generating body can be formed easily according to an example of an electric circuit formation, and variations in a resistance value can be suppressed and further, an adverse affect to the heat generating body, such as disconnection or the like can be eliminated.

An integrated circuit and a capacitor can be further provided on the substrate, and thereby, an igniter for an inflator which can be employed in a bus system can be provided. Particularly, a slurry pyrotechnic material is used in the present invention, and even when an igniter which can be employed in a bus system is formed, a capacitor or an integrated circuit is prevented from being adversely affected. That is, if powdery pyrotechnic material is used and this material is pressure-charged in the above manner, it is expected that a pressure at the pressure-charging time adversely affects a capacitor or an integrated circuit which is an electric/electronic circuit part, but such a problem can be solved in the present invention. Therefore, according to the present invention, in an igniter which can be employed in a bus system having such an integrated circuit and a capacitor, an igniter for an inflator, in which the pyrotechnic material and the heat generating body (the heat generating portion) make contact with each other securely and an electronic part such as an integrated circuit, a capacitor or the like is never damaged due to influence of a pressure or the like, is provided.

Further, the present invention provides, as another means for solving the above-described problem, a method of manufacturing an igniter for an inflator comprising: preparing a pyrotechnic material slurry including a fuel component and an oxidizing agent component dispersed in a solvent; dropping the pyrotechnic material slurry on a heat generating body, which generates heat by an ignition current, of a header member formed in a plate shape; and drying the dropped pyrotechnic material slurry.

In the manufacturing method of the present invention, the pyrotechnic material slurry is dropped on the heat generating body provided on the header portion and dried. Thereby, a close contact between the pyrotechnic material and the heat generating body is made secure, so that an operation security can be ensured. Further, since it is unnecessary to press the heat generating body against the dried and solidified slurry, the heat generating body is prevented from being damaged and disconnected.

In the igniter for an inflator and the method of manufacturing the same according to the present invention, the step of preparing the pyrotechnic material slurry desirably includes the sub-steps of forming a fuel slurry obtained by dispersing a fuel component and a binder component into a solvent, and forming a pyrotechnic material slurry by adding an oxidizing agent component to the fuel slurry. In particular, in the case where the fuel component comprises only a metal component which is difficult to handle in a powdery state because of a high ignition sensitivity, by dispersing the fuel component in the solvent together with a binder, handling of the fuel component in the powdery state can be prevented. Therefore, safety during manufacturing is provided in that the danger of ignition of the fuel component can be eliminated. For example, when zirconium described below is used as the fuel component, its powder has a very high sensitivity to be ignited easily, but safety during manufacture can be elevated by handling zirconium in such a state that it is dispersed in a solvent.

By adding a binder in the pyrotechnic material slurry, preferably in the fuel slurry, the heat generating body and the dried slurry can make contact with each other securely without applying a physical force such a pressure-charging or applying a force with a structural feature or the like.

The fuel slurry or the pyrotechnic material slurry has a viscosity of 1,000 to 500,000 centipoises, preferably a viscosity of 5,000 to 300,000 centipoises, further preferably a viscosity of 10,000 to 100,000 centipoises, and it is desirable to stir this slurry. By setting the viscosity in this range, a stirring work becomes easy and respective components can be evenly mixed. When the viscosity of the slurry to be stirred is higher than 500,000 centipoises, it becomes difficult to mix respective components, and when the slurry drops on the heat generating body, a projection is formed easily as described below. On the contrary, when the viscosity is lower than 1,000 centipoises, a drying time of the pyrotechnic material after the slurry dropped on the heat generating body becomes excessively long, which results in inconvenience in manufacture. The viscosity can be set in this range not only by adjusting the temperature, the surrounding temperature or the like of the fuel slurry or the pyrotechnic material slurry but also by adjusting the amount of addition of the solvent.

In the step of dropping the pyrotechnic material slurry on the heat generating body, it is desirable that the step is conducted while the slurry is being stirred. Since the metal component included in the pyrotechnic material slurry has a large specific gravity, it gravitates according to time elapse. In view of this, it is desirable that the slurry is dropped, while it is being stirred, so that respective components are evenly dispersed without gravitation of the fuel component. In particular, when the viscosity of the slurry is kept low in order to have respective components evenly dispersed or the like, the metal material becomes especially easy to gravitate. Consequently, the importance of dropping the pyrotechnic material slurry on the heat generating body while it is being stirred is great.

Prior to dropping the pyrotechnic material slurry on the heat generating body, desirably, a charge holder, provided with a peripheral surface surrounding the heat generating body, is mounted at the side of the header member formed in a plate shape where the heat generating body exists. If the charge holder is mounted in advance, at the time of dropping the pyrotechnic material slurry on the heat generating body, the pyrotechnic material slurry can be dropped into a space defined by the header member and the charge holder.

The charge holder is maintained even after dropping of the pyrotechnic material slurry, and it can be used for forming a space accommodating the pyrotechnic material in the igniter. The charge holder is usually made of the same material as that of the header. For example, when the header is made of stainless steel, the charge holder can also be made of stainless steel. Incidentally, the charge holder and the header can also be made of different materials. The charge holder is cylindrical and it is mounted to the header by welding its one end portion to the header. At this time, in order to prevent the charge holder from scattering at the time of activation of the igniter, the charge holder and the header have to be welded to each other securely. However, alternatively, the charge holder can be formed of inflammable material such as synthetic resin or the like, so that it can break or burn during activation of the igniter. If the charged holder is formed in this way, the charge holder is prevented from scattering because it is burnt during the activation of the igniter. When the charge holder is formed of inflammable material such as synthetic resin or the like, a material which does not change due to a drying temperature in a step of drying the slurry described latter is used as the inflammable material. The material depends on a drying temperature, but it is preferable to use, for example, epoxy or the like as such a material, taking into consideration fixing to the header easily using adhesive or the like. The charge holder formed of an inflammable material only serves as a kind of a mold when the pyrotechnic material slurry is dropped on the header. Once the slurry is solidified, the role as the charge holder is terminated. When the pyrotechnic material is ignited, the charge holder is also burnt out and it is not scattered.

As the fuel component, powdery material is used, and powder selected from the group consisting of zirconium, iron, tin, manganese, cobalt, nickel, tungsten, titanium, magnesium, aluminum, niobium and a mixture thereof can be used, and, among them, powder consisting of zirconium is preferable.

As the oxidizing agent component, powder material is used, and powder selected from the group consisting of a perchloric acid salt such as potassium perchlorate, lithium perchlorate, sodium perchlorate or the like and nitric acid salt such as potassium nitrate, and a mixture thereof can be used, and, among them, powder consisting of potassium perchlorate is preferable.

As the solvent for dispersing the fuel component and the oxidizing agent component, an organic solvent such as isopropyl alcohol, methyl ethyl ketone, hexane, and the like can be used.

The binder mixed in the pyrotechnic material slurry can be cellulose resin, urethane resin, fluorine-contained rubber composition. Further, in the pyrotechnic material slurry, an additive selected from the group consisting of glass powder, glass fiber, ceramic fiber, steel wool, bentonite, kaolinite, and a mixture thereof can be used. In particular, when potassium perchlorate is used as the oxidizing agent component, it is desirable that the binder is selected from the group consisting of hydroxypropyl cellulose, nitrocellulose, and urethane. This is because potassium perchlorate is prevented from being dissolved in the binder.

As the heat generating body which generates heat with an ignition current, one comprising a printed circuit or one including an integrated circuit and a capacitor can also be used besides a bridge wire of an electric resistance wire.

Further, by forming an inflator for an air bag using the igniter for an inflator, an inflator for an air bag which can be activated unfailingly is provided.

That is, the present invention provides an inflator for an air bag used in an inflatable safety system, comprising, in a housing having a gas discharging port, an igniter which activates an inflator and a gas generating means actuated by activation of the igniter, wherein the igniter of this invention is used as an igniter.

As described above, in the igniter for an inflator according to the present invention, the pyrotechnic material securely contacts the heat generating body while any damage or cut of the heat generating body is not caused. Therefore, an igniter is unfailingly activated upon receiving an activating signal to activate the gas generating means, and consequently, such an inflator for an airbag that can be unfailingly activated at need is provided.

Therefore, the igniter for an inflator according to the present invention can be used in varieties of inflators such as a hybrid type inflator, an inflator used for inflating a curtain-like air bag, a pyrotechnic inflator, an inflator used in a seatbelt pretensioner, a knee bolster or the like, and others, for varieties of purposes such as for activating a gas generating means, for rupturing a member sealing a gas for inflating an air bag or the like.

The method of manufacturing an igniter for an inflator of the present invention is a method by which a bridge wire or other heat generating body for generating heat with an ignition current is not damaged, the heat generating body securely makes contact with a pyrotechnic material, and the manufacturing process is facilitated. The igniter for an inflator according to the present invention is an igniter in which the heat generating body is never damaged and the heat generating body securely makes contact with the pyrotechnic material, and that unfailingly activates at need.

DETAILED DESCRIPTION OF THE INVENTION

Figure 1:
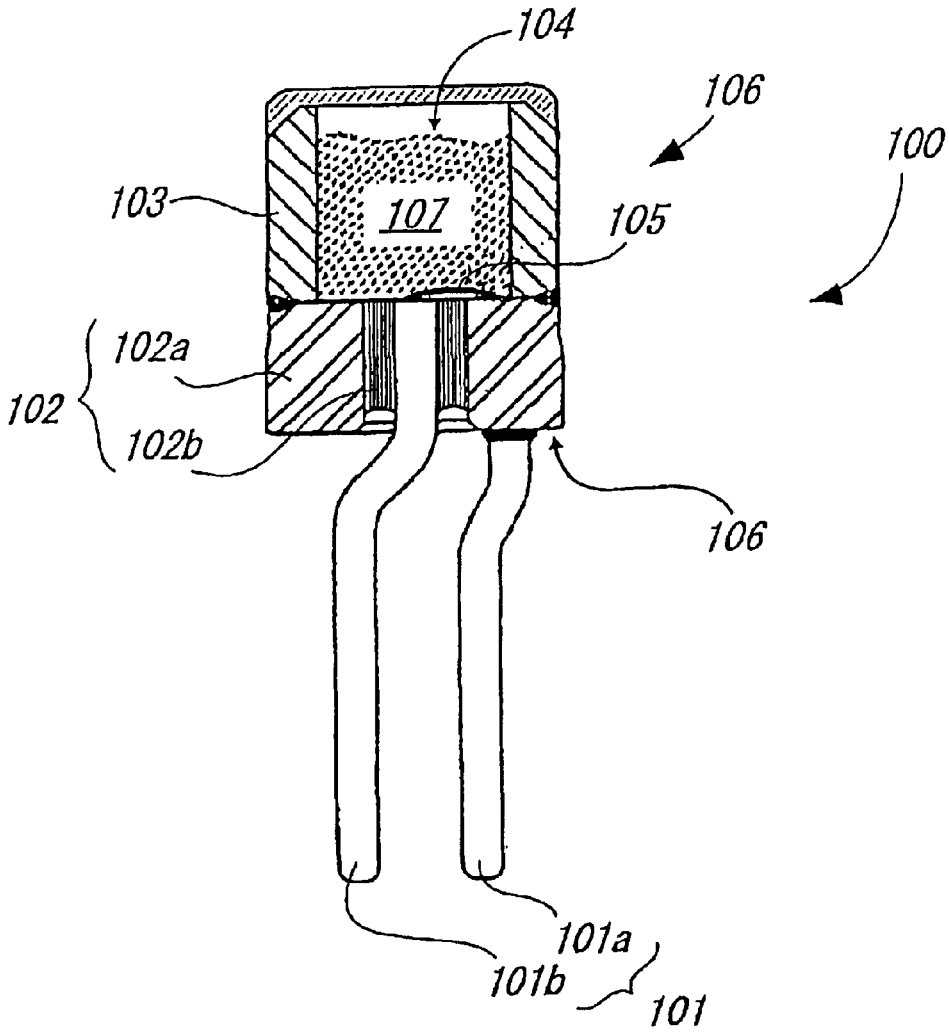
FIG. 1 is a vertical sectional view showing an igniter for an inflator.

The present invention will be explained below in detail with reference to the drawings showing embodiments of the present invention. FIG. 1 is an axial sectional view showing an embodiment of an igniter 100 for an inflator, FIGS. 2(*a*)–2(*d*) are process diagrams showing a method of manufacturing the igniter 100 for an inflator shown in FIG. 1, and FIG. 3 is an axial sectional view showing an embodiment of another igniter 200 for an inflator.

In the igniter 100 for an inflator shown in FIG. 1, a pair of electroconductive pins 101*a* and 101*b* for receiving an electric activating signal are held by a plate-like header member 102 in an insulated state and a cylindrical charge holder 103 is provided along an edge of the header member 102 in a standing manner, a bridge wire 105 made of a heat generating body which converts electric energy into thermal energy is provided on a bottom surface in a space (namely, a pyrotechnic material accommodating space 104) formed by the charge holder 103 and the header member 102, in other words, on an upper surface of the header member 102, thereby forming an igniter sub-assembly 106. By accommodating a pyrotechnic material 107 in the pyrotechnic material accommodating space 104 in the igniter sub-assembly 106, the igniter 100 for an inflator is constituted.

In the igniter sub-assembly 106 in this embodiment, one electroconductive pin 101*a* is joined to an annular portion 102*a* comprising an electroconductive body in the header portion 102 to allow electrical conduction thereto. In an electric insulating body 102*b*, such as glass or the like, filled in a hole portion existing at the center of the annular portion 102*a* in the header portion 102, the other electroconductive pin 101*b* is provided such that its end surface is exposed from the hole defined by an upper surface of the header portion 102. An upper surface of the annular portion 102*a*, an upper surface of the electric insulating body 102*b* and an end surface of the electroconductive pin 101 extending through the central hole portion of the annular portion 102*a* become flush with one another, and a heat generating body which generates heat by an ignition current, namely, the bridge wire 105 is spanned between the upper surface of the annular portion 102*a* and the end surface of the electroconductive pin 101*b* held by the electric insulating body 102*b*.

In the igniter sub-assembly 106 of this embodiment, a cylindrical charge holder 103 extending along a peripheral edge of the header portion 102 is provided on a face of the header portion 102 on which the bridge wire 105 is provided, and both are joined together. Incidentally, the charge holder 103 may also be formed integrally with the header portion 102. Such a constitution may be employed that the header member 102 and the charge holder 103 are formed of the same material and one end portion of the charge holder 103 is mounted to the header member 102 by welding, or such a constitution may be employed that the header member 102 and the charge holder 103 are formed of different materials (for example, the header member 102 is formed of stainless steel while the charge holder 103 is formed of an inflammable material) and both are fixed to each other by an adhesive. Further, such a constitution may be employed that the header member 102 is formed of an insulating material such as resin and the end surfaces of respective electroconductive pins 101 are exposed on the upper surface of the header member 102, and the bridge wire 105 is spanned between the end surfaces of the electroconductive pins 101.

In this embodiment, the pyrotechnic material 107 accommodated in the space 104 defined by the header portion 102 and the charge holder 103 is one obtained in such a manner that a pyrotechnic material slurry 107*s* which includes a fuel component 107*a* and an oxidizing agent component 107*b* and is dispersed in a solvent is filled into the pyrotechnic material accommodating space 104 and dried. In this connection, one example of a method of manufacturing the igniter 100 for an inflator will be explained with reference to FIG. 2.

Figure 2:
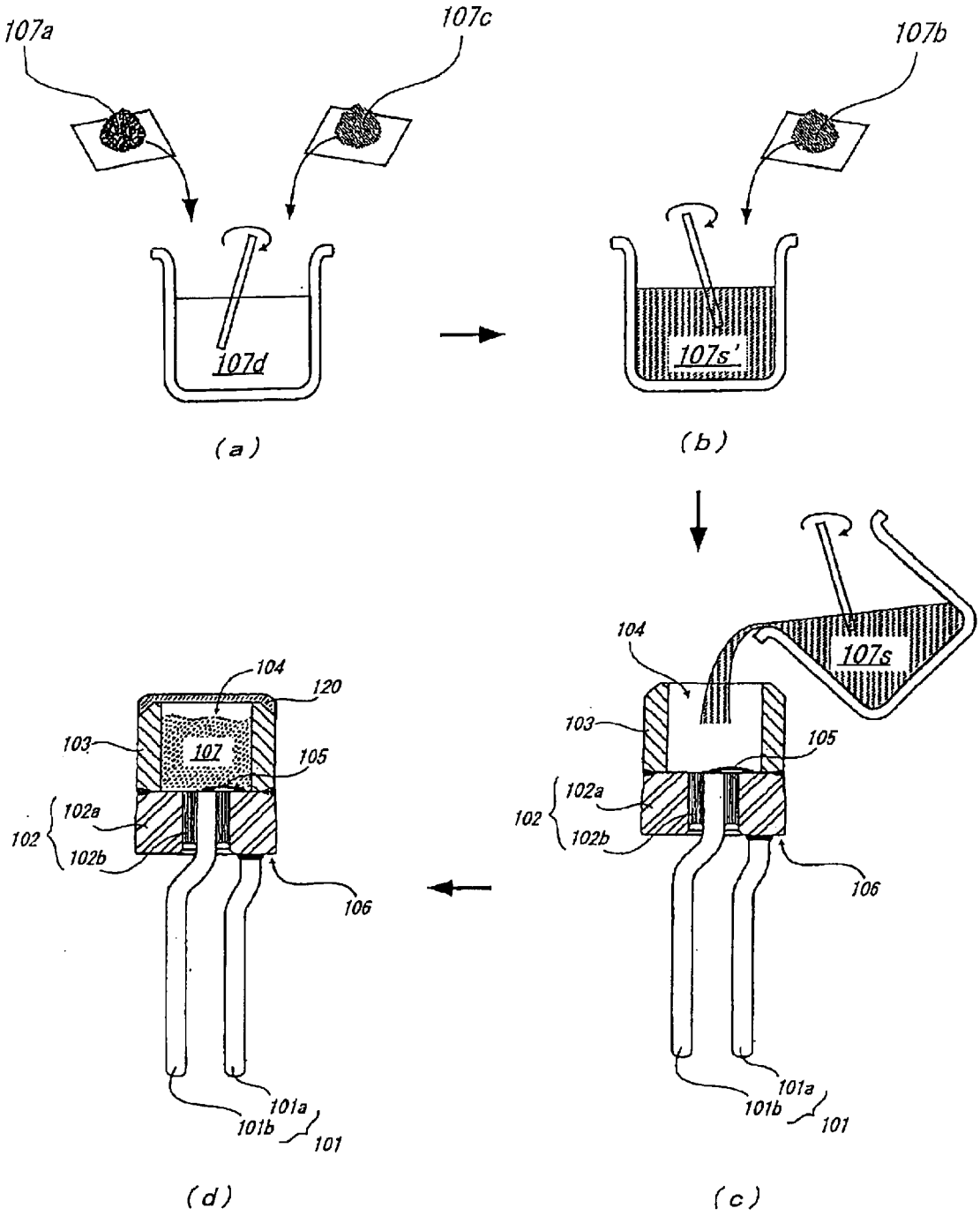
FIGS. 2(*a*)–2(*d*) are process diagrams showing a method of manufacturing an igniter for an inflator.
Figure 3:
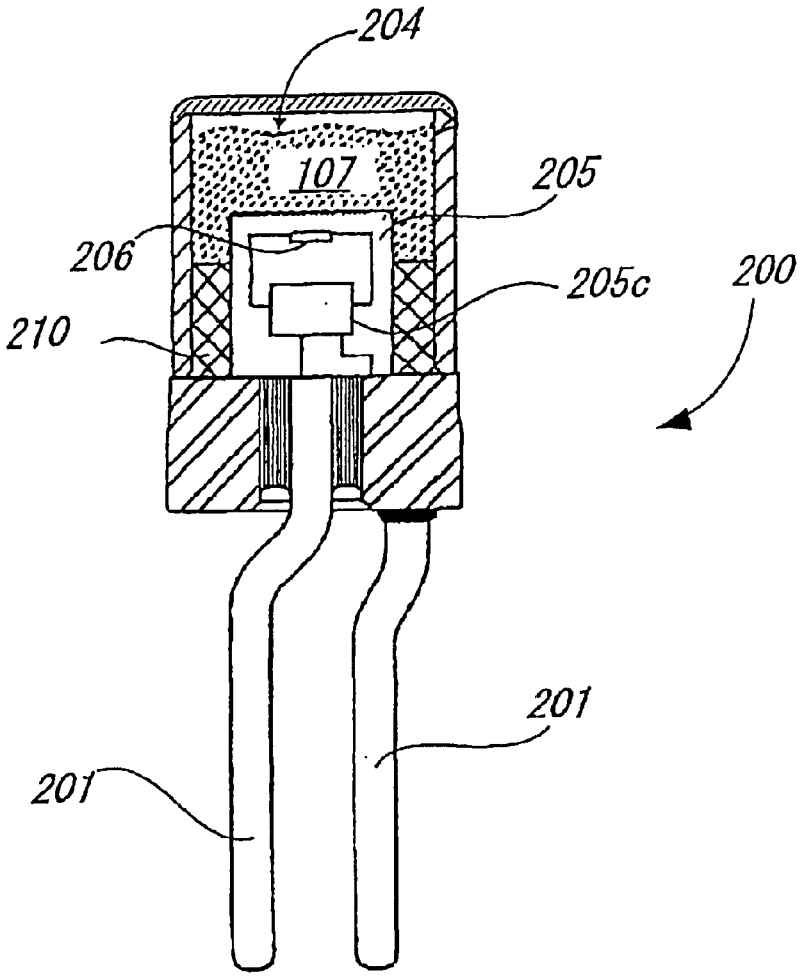
FIG. 3 is a vertical sectional view showing another igniter for an inflator.

First, a fuel slurry 107*s*' is prepared by dispersing a fuel component 107*a* comprising zirconium powder and a binder 107*c* selected from the group consisting of hydroxypropyl cellulose, nitrocellulose, and urethane in a solvent 107*d* selected from the group consisting of isopropyl alcohol, methyl ethyl ketone, hexane and the like, and this slurry is stirred to have a viscosity of 1,000 to 500,000 centipoises (FIG. 2(*a*)).

Next, potassium perchlorate is mixed in the fuel slurry 107*s*' as the oxidizing agent component 107*b* to form a pyrotechnic material 107 slurry, and the slurry is stirred to have a viscosity of 1,000 to 500,000 centipoises (FIG. 2(*b*)).

Since the fuel slurry 107*s*' and the pyrotechnic material slurry 107*s* are set to have the viscosity of 1,000 to 500,000 centipoises, respective components 107*a* to 107*c* can be dispersed at a high level. Then, zirconium powder which is the fuel component 107*a* together with the binder 107*c* is dispersed in the solvent 107*d* to be used, an unintentional firing can be prevented during manufacture.

After the pyrotechnic material slurry 107*s* is sufficiently stirred so that respective components are dispersed sufficiently, it is charged in the space formed by the header member 102 and the charge holder 103 in the ignition sub-assembly 106, namely, the pyrotechnic material accommodating space 104 while it is being stirred (FIG. 2 (*c*)). By charging the pyrotechnic material slurry 107*s* while stirring the same, unevenness of composition due to sinking of the fuel component during charging can be prevented.

After the pyrotechnic material slurry 107*s* charged in the pyrotechnic material accommodating space 104 is dried, the space 104 is closed (FIG. 2 (*d*)). Regarding the closing of the charge holder 103, as shown in FIG. 2(*d*), an opening portion of an opened end portion (an upper end) of the charge holder 103 may be closed by a lid member 120 covering only the opening portion, or the opening portion can be closed by covering the opening portion with a lid member with a peripheral edge, which has a peripheral wall portion extending to the charge holder, and welding (laser-welding or the like) an lower end portion of the peripheral wall portion to an outer peripheral portion of the header. When the lid member 120 is fixed by welding, the latter case is more preferable even in view of suppressing thermal influence to the pyrotechnic material 107. In particular, as described above, the pyrotechnic material slurry 107*s* charged into the space 104 is adjusted to have a viscosity of 1,000 to 500,000 centipoises, so that the drying time is not prolonged excessively.

Since, in the above manufacturing method, the pyrotechnic material 107 is formed in a slurry state (107*s*) to be charged (FIG. 2(*c*)), it is unnecessary to pressure-charge the pyrotechnic material to press the same against the bridge wire 105, or press the bridge wire 105 against the dried and solidified pyrotechnic material, and the bridge wire 105 is therefore prevented from being damaged. Further, since charged pyrotechnic material slurry 107*s* is dried as it is, the bridge wire 105 and the pyrotechnic material 107 are securely brought in close contact with each other.

FIG. 3 shows another embodiment of an igniter 200 for an inflator constituted to use an integrated circuit 205*c* as the heat generating body for converting an electric energy into a thermal energy. The igniter 200 shown in this figure is an igniter 200 which can correspond to a bus system provided in a vehicle and it can be constituted to include an integrated circuit 205*c*, a capacitor or the like.

The igniter 200 is provided on its substrate with the integrated circuit 205*c* and a heat generating portion 206, and it is an igniter having such a structure that a resin 210 surrounds the above members except for the heat generating portion 206 and the heat generating portion projects into the pyrotechnic material accommodating space 204. A pair of electroconductive pins 201 are connected to the circuit. With this structure, when an electroconductive pin 201 receives an activation signal, the integrated circuit 201 determines whether or not to activate, and if it is necessary to activate, a heat is generated to ignite and burn the pyrotechnic material 107.

Even in the igniter 200, since slurry-like material (107*s*) is charged into the pyrotechnic material accommodating space 204 as the pyrotechnic material 107, the heat generating portion 206 and the pyrotechnic material 107 can be securely brought into close contact with each other without damaging the substrate 205 (substantially, the integrated circuit 205*c*, the capacitor or the like).

What is claimed is:

1. An igniter, comprising:

a header member retaining, on an upper surface thereof, a heat generating body that generates heat by an ignition current;

a cylindrical support member provided on said header member such that said cylindrical support member surrounds the heat generating body and defines, in conjunction with the upper surface, a pyrotechnic material accommodating space therein; and a pyrotechnic material slurry provided inside the pyrotechnic material accommodating space after providing said cylindrical support member on said header member and in contact with the heat generating body by dripping the pyrotechnic material slurry into the pyrotechnic material accommodating space and in contact with the heat generating body.

2. An igniter for an inflator according to claim 1, wherein the pyrotechnic material slurry includes an oxidizing agent component added to a fuel slurry obtained by dispersing a fuel component into a solvent, and the fuel slurry has a viscosity of 1,000 to 500,000 centipoises.

3. An igniter for an inflator according to claim 1, wherein the pyrotechnic material slurry is formed by adding an oxidizing agent component into a fuel slurry obtained by dispersing a fuel component into a solvent, and the pyrotechnic material slurry has a viscosity of 1,000 to 500,000 centipoises.

4. An igniter for an inflator according to claim 1 or 2, wherein the solvent is selected from the group consisting of alcohols, ketones, acetates, alkanes, and a mixture thereof.

5. An igniter for an inflator according to claim 1, wherein the pyrotechnic material slurry further includes a binder selected from the group consisting of cellulose derivatives, urethanes, rubbers, and a mixture thereof.

6. An igniter for an inflator according to claim 5, wherein the cellulose derivatives includes hydroxypropyl cellulose.

7. An igniter for an inflator according to claim 1 or 2, wherein the pyrotechnic material slurry is further mixed with one selected from the group consisting of glass powder, glass fiber, ceramic fiber, steel wool, bentonite, kaolinite, and a mixture thereof.

8. An igniter for an inflator according to claim 5, wherein the oxidizing agent component is potassium perchlorate, and the binder is selected from the group consisting of hydroxypropyl cellulose, nitrocellulose, and urethane.

9. An igniter for an inflator according to claim 1 or 2, wherein the cylindrical support member is formed of a synthetic resin.

10. An igniter for an inflator according to claim 1, wherein the heat generating body is formed on a substrate as a heat generating portion, at a part of the substrate is disposed in the pyrotechnic material accommodating space.

11. An igniter for an inflator according to claim 10, wherein the substrate is further provided with an integrated circuit and a capacitor.

12. A method of manufacturing an igniter, comprising:

providing a header member having an upper surface;

providing a heat generating body, on the upper surface, that generates heat by applying an ignition current;

providing a cylindrical supporting member on the header member such that said cylindrical support member surrounds the heat generating body and defines, in conjunction with the upper surface, a pyrotechnic material accommodating space therein; and dripping, after said cylindrical supporting member providing step, a pyrotechnic material slurry into the pyrotechnic material accommodating space and in contact with the heat generating body.

13. The manufacturing method according to claim 12, further comprising:

preparing the pyrotechnic material slurry by stirring a fuel slurry obtained by dispersing the fuel component and a binder component in the solvent with a viscosity of 1,000 to 500,000 centipoises.

14. The manufacturing method according to claim 13, wherein the pyrotechnic material slurry preparing step includes the step of stirring a pyrotechnic material slurry obtained by further adding the oxidizing agent component into a fuel slurry with a viscosity of 1,000 to 500,000 centipoises.

15. The manufacturing method according to claim 12, wherein the pyrotechnic material slurry further includes a binder selected from the group consisting of cellulose derivatives, urethanes, rubbers, and a mixture thereof.

16. The manufacturing method according to claim 15, wherein the cellulose derivatives include hydroxypropyl cellulose.

17. The manufacturing method according to claim 13, wherein the pyrotechnic material slurry is further mixed with one selected from the group consisting of glass powder, glass fiber, ceramic fiber, steel wool, bentonite, kaolinite, and a mixture thereof.

18. The manufacturing method according to claim 13, wherein the fuel component is powder selected from the group consisting of zirconium, iron, tin, manganese, cobalt, nickel, tungsten, titanium, magnesium, aluminum, niobium, and a mixture thereof, and the oxidizing agent component is powder selected from the group consisting of potassium perchlorate, lithium perchlorate, sodium perchlorate, and a mixture thereof.

19. The manufacturing method according to claim 13, wherein the oxidizing agent component is potassium perchlorate, and the pyrotechnic material slurry further includes a binder selected from the group consisting of hydroxypropyl cellulose, nitrocellulose, and urethane.

20. The manufacturing method according to claim 12 or 13, wherein the dripping step is conducted while the pyrotechnic material slurry is being stirred.

21. The manufacturing method according to claim 12, wherein the cylindrical supporting member providing step includes the step of preparing a charge holder having a peripheral wall surface, and mounting the charge holder on the upper surface of the header member such that the charge holder surrounds the heat generating body, and the dripping step includes the step of dripping the pyrotechnic material slurry in the space defined by the upper surface and the charge holder.

22. The manufacturing method according to claim 21, wherein the charge holder is formed of a synthetic resin.

23. An igniter for an inflator according to claim 1, wherein the pyrotechnic material slurry includes an oxidizing agent component added to a fuel slurry obtained by dispersing a fuel component into a solvent.

24. An igniter for an inflator according to claim 1, wherein the pyrotechnic material slurry is dried after being dripped.

25. The manufacturing method according to claim 12, further comprising:

preparing the pyrotechnic material slurry by stirring a fuel slurry obtained by dispersing the fuel component and a binder component in the solvent.

26. The manufacturing method according to claim 12, further comprising:

drying the dipped pyrotechnic material slurry.

* * * * *